US006530850B2

(12) United States Patent
Sajima

(10) Patent No.: US 6,530,850 B2
(45) Date of Patent: Mar. 11, 2003

(54) GOLF BALL

(75) Inventor: Takahiro Sajima, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/874,201

(22) Filed: Jun. 6, 2001

(65) Prior Publication Data

US 2002/0034990 A1 Mar. 21, 2002

(30) Foreign Application Priority Data

Jun. 7, 2000 (JP) ..... 2000-169995

(51) Int. Cl.[7] ..... A63B 37/14
(52) U.S. Cl. ..... 473/382
(58) Field of Search ..... 473/378, 382, 473/383, 384

(56) References Cited

U.S. PATENT DOCUMENTS 4,720,111 A 1/1988 Yamada
5,145,180 A 9/1992 Oka
5,149,100 A * 9/1992 Melvin et al. ..... 473/383
5,156,404 A 10/1992 Oka et al.
5,415,410 A * 5/1995 Aoyama ..... 473/382

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

A surface is comparted into eight spherical regular triangles (T1 to T8) through twelve comparting lines formed by projecting, onto the surface, twelve sides of a regular octahedron inscribed on the surface. Dimples are arranged in the spherical regular triangles (T1 to T8) so as not to intersect any of the comparting lines. Consequently, three great circle paths (L1), (L2) and (L3) are formed. Each of four spherical regular triangles sharing each of six apexes (P1 to P6) has different dimple pattern from those of three other spherical regular triangles, respectively. In the golf ball, it is possible to prevent dimple effects from being reduced when one of the three great circle paths (L1), (L2) and (L3) is coincident with the highest speed portion.

7 Claims, 7 Drawing Sheets

T2 (II)

T3 (III)

T4 (IV)

GOLF BALL

BACKGROUND OF THE INVENTION

1. Field of the Invention

The present invention relates to a golf ball and more particularly to a dimple pattern of the golf ball.

2. Description of the Related Art

A golf ball has approximately 300 to 550 dimples on a surface thereof. The role of the dimples resides in one aspect that such dimples disturb an air stream around the golf ball during the flight of the golf ball to accelerate transition of a turbulent flow at a boundary layer, thereby causing a turbulent flow separation (which will be hereinafter referred to as a "dimple effect"). The acceleration of the transition of the turbulent flow causes a separating point of air from the golf ball to be shifted backwards so that a pressure resistance is reduced, resulting in an increase in a flight distance of the golf ball. Moreover, the acceleration of the transition of the turbulent flow increases a distance between upper and lower separating points of the golf ball which is caused by backspin. Consequently, lift acting on the golf ball is increased. Accordingly, a dimple pattern capable of easily accelerating the transition of the turbulent flow, that is, a dimple pattern capable of better disturbing an air stream is more excellent aerodynamically.

A regular polyhedron or a quasi-regular polyhedron (which will be hereinafter referred to as a "polyhedron) is often used for the dimple pattern. More specifically, a polyhedron inscribed on a sphere is supposed, and sides of the polyhedron are projected on a spherical surface by rays irradiated from the center of the sphere onto the spherical surface, thereby forming a comparting line. The spherical surface is comparted by the comparting line. Thus, the dimples are arranged. Examples of the polyhedron to be used include a regular hexahedron, a regular octahedron, a regular dodecahedron, a regular icosahedron, a cube-octahedron, an icosa-dodecahedron and the like.

The regular octahedron has been admired for a general golf ball for a long time because dimples are systematically aligned finely. Twelve comparting lines obtained by projecting twelve sides of the regular octahedron form three great circles. These great circles are orthogonal to each other. The spherical surface is comparted into eight spherical regular triangles through the comparting lines (that is, three great circles). Dimples are arranged equivalently on the inside of each spherical regular triangle. The dimple does not intersect the twelve comparting lines. Accordingly, the three great circles do not intersect the dimple. Portions corresponding to the great circles act as great circle paths where the dimple is not present. By the existence of the great circle path, for example, there is an advantage that a directional alignment can easily be carried out before patting. Such a dimple arranging method is referred to as a regular octahedron pattern.

The golf ball is formed by upper and lower molds comprising semispherical cavities. A spew is generated in a portion (a so-called seam) corresponding to the parting lines of the upper and lower molds on the surface of the formed golf ball. The spew is ground and removed through a grindstone or the like. In an ordinary regular octahedron pattern, one of the three great circle paths is coincident with the seam. Consequently, the dimple is not present on the seam and the spew can easily be removed. Such a golf ball has been disclosed in Japanese Laid-Open Patent Publication No. Sho 60-11665 (1985/11665).

In the golf ball having the regular octahedron pattern, dimples are not present on the seam. Therefore, a dimple effect tends to be insufficient when the seam (to be the great circle path) is coincident with a portion in which a circumferential speed of backspin is the highest (which will be hereinafter referred to as the "highest speed portion"). As described above, the spew generated on the seam is removed by the grinding, so there is a possibility that the vicinity of the seam might be ground simultaneously and the dimples might be deformed, resulting in a reduction in the dimple effect. Furthermore, the dimple patterns on the right and left of the seam are equivalent to each other and the equivalent dimple patterns appear repetitively along the seam during the rotation of the golf ball. Therefore, the dimple effect tends to be insufficient when the seam is coincident with the highest speed portion. In the golf ball having the regular octahedron pattern, the following three unfavorable conditions are satisfied on the seam:

(1) the seam is a great circle path having no dimple;

(2) dimples provided around the seam might be deformed by cutting; and (3) a dimple pattern appearing along the seam by rotation is monotonous.

The drawbacks (1) and (3) described above are caused when one of other great circle paths, as well as the seam, is coincident with the highest speed portion.

Japanese Laid-Open Patent Publication No. Hei 4-126166 (1992/126166) has disclosed a golf ball in which a regular octahedron pattern is based, a mold is devised and one great circle path is provided. Moreover, Japanese Laid-Open Patent Publication No. Hei 4-150875 (1992/150875) has also disclosed a golf ball in which a dimple pattern is similar to the regular octahedron pattern and one great circle path is provided. In these golf balls, it is possible to prevent the dimple effect from being reduced when a great circle other than the seam is coincident with the highest speed portion. However, when the seam is coincident with the highest speed portion, the drawbacks (1) to (3) are still caused. In these golf balls, moreover, one great circle path is provided so it is hard to obtain an original advantage of the regular octahedron pattern, that is, the easiness of a directional alignment before patting.

SUMMARY OF THE INVENTION

In consideration of the above-mentioned problems, it is an object of the present invention to provide a golf ball having three great circle paths and capable of preventing dimple effects from being reduced when the great circle path is coincident with the highest speed portion.

In order to achieve the above-mentioned object, the present invention provides a golf ball in which a surface thereof is comparted into eight spherical regular triangles through twelve comparting lines formed by projecting, onto the surface, twelve sides of a regular octahedron inscribed on the surface and dimples are arranged in the spherical regular triangles so as not to intersect any of the comparting lines, resulting in formation of three great circle paths, wherein each of four spherical regular triangles sharing each of six apexes of the regular octahedron positioned on the surface has different dimple pattern from those of three other spherical regular triangles, respectively.

The expression of "different dimple patterns" implies such a state that the dimples do not completely overlap each other even if the two spherical regular triangles to be compared overlap each other in any way. In the golf ball, since any of the comparting lines does not intersect the dimples, three great circle paths are present on the surface. Accordingly, it is possible to maintain an advantage of the regular octahedron pattern that the dimples are provided finely and the directional alignment of the golf ball can easily be carried out.

In the golf ball, also in the case in which any of the three great circle paths is coincident with the highest speed portion, the four spherical regular triangles appearing on the right side of the highest speed portion through the rotation of the golf ball have different dimple patterns from each other. Moreover, the four spherical regular triangles appearing on the left side of the highest speed portion through the rotation of the golf ball also have different dimple patterns from each other. In other words, the dimple patterns appearing through the rotation are not monotonous. Accordingly, it is possible to complement a reduction in the dimple effects caused by the great circle path. Consequently, the flight distance of the golf ball can be increased, and furthermore, flight performance can be prevented from being varied depending on a position of the highest speed portion.

It is preferable that all the eight spherical regular triangles should have dimple patterns which are rotational symmetrical. Consequently, if any of the three great circle paths is coincident with the highest speed portion, the individual spherical regular triangles can produce the dimple effects equivalently.

It is preferable that one to three of four spherical regular triangles sharing each of the six apexes of the regular octahedron should have dimple patterns which are rotational symmetrical and line symmetrical (hereinafter referred to as "rotational symmetrical/line symmetrical") and the other spherical regular triangles should have dimple patterns which are rotational symmetrical and are not line symmetrical (hereinafter referred to as "rotational symmetrical/non-line symmetrical"). This state can also be achieved in any of the six apexes of the regular octahedron. More specifically, even if any of the great circle paths is coincident with the highest speed portion, the spherical regular triangle which is rotational symmetrical/line symmetrical and the spherical regular triangle which is rotational symmetrical/non-line symmetrical are mixed on the right side of the great circle path. Similarly, the spherical regular triangle which is rotational symmetrical/line symmetrical and the spherical regular triangle which is rotational symmetrical/non-line symmetrical are mixed on the left side of the great circle path. Consequently, the dimple patterns appearing through the rotation are not monotonous. It is the most preferable that two of the four spherical regular triangles sharing each of the six apexes should be rotational symmetrical/line symmetrical and two other spherical regular triangles are rotational symmetrical/non-line symmetrical.

It is preferable that each of the spherical regular triangles has 40 to 55 dimples arranged therein. Consequently, excellent dimple effects can be obtained and the flight performance of the golf ball can be enhanced.

In the eight spherical regular triangles, a difference between the number of dimples in the spherical regular triangle having the greatest number of dimples arranged therein and the number of dimples in the spherical regular triangle having the smallest number of dimples arranged therein is preferably four or less. Consequently, the aerodynamic symmetry of the golf ball can be enhanced.

It is preferable that one of the three great circle paths should be coincident with a seam to be a portion corresponding to a parting line of a pair of golf ball molds having semispherical cavities. Consequently, a spew can be removed easily. Since the great circle path is coincident with the seam, such a drawback that the dimple might not be present and surrounding dimples might be deformed through grinding is caused on the seam. However, the dimple pattern appearing through the rotation is not monotonous. Therefore, it is possible to prevent the dimple effects from being reduced when the seam is coincident with the highest speed portion.

DESCRIPTION OF THE PREFERRED EMBODIMENTS

The present invention will be described below in detail based on a preferred embodiment with reference to the drawings.

Figure 1:
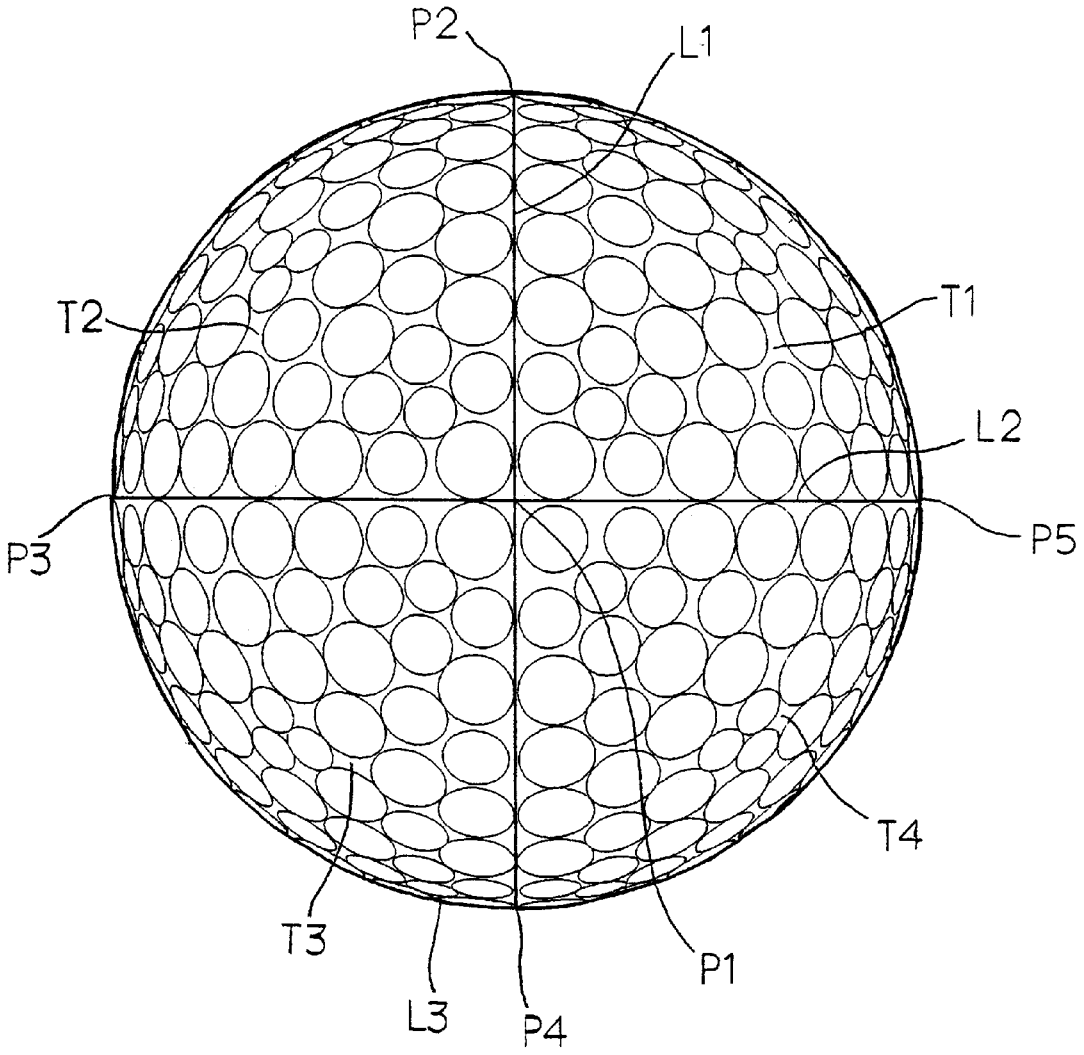
FIG. 1 is a front view showing a golf ball according to an embodiment of the present invention.
Figure 2:
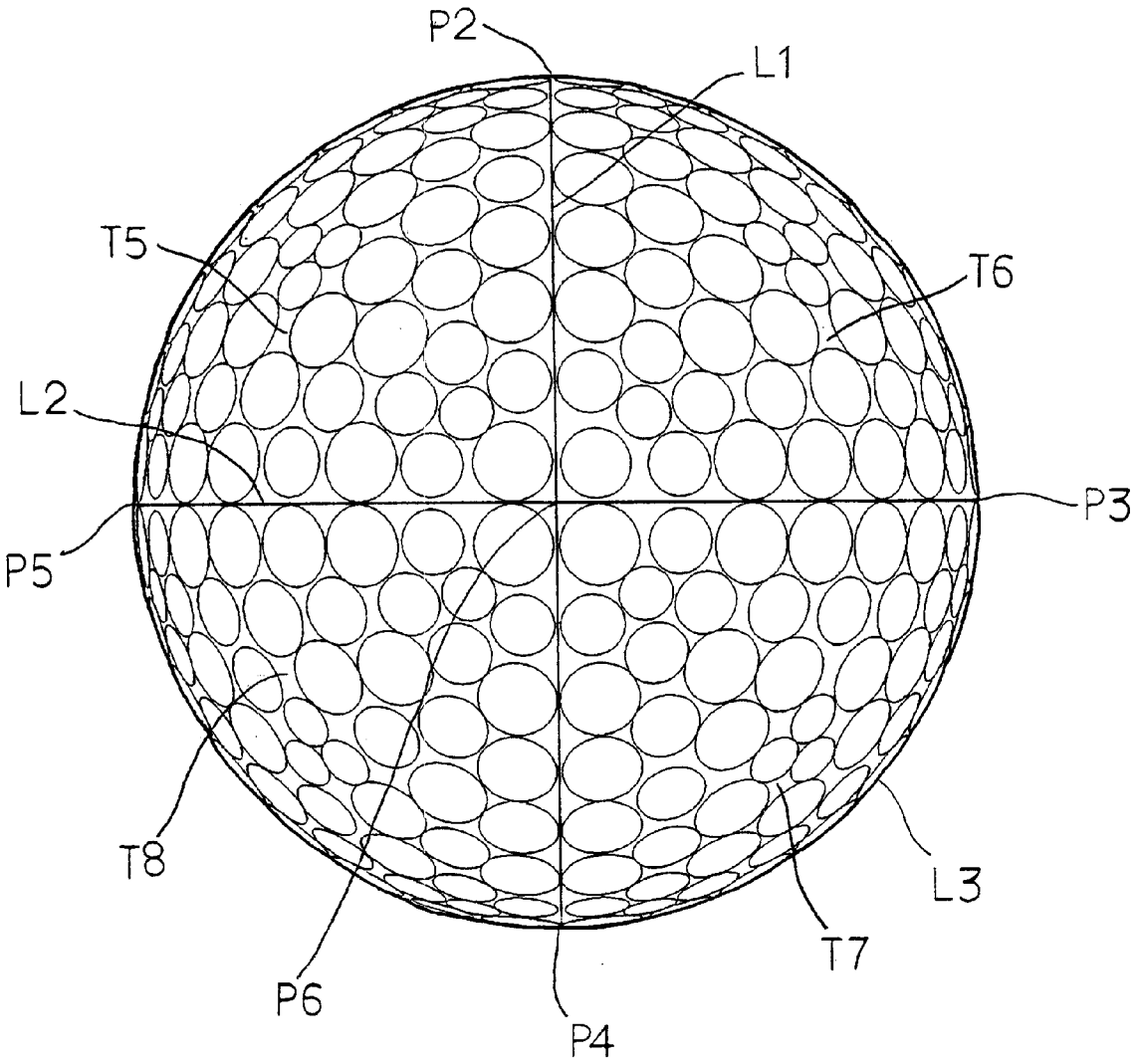
FIG. 2 is a rear view showing the golf ball of FIG. 1.

FIG. 1 is a front view showing a golf ball according to an embodiment of the present invention, and FIG. 2 is a rear view showing the golf ball of FIG. 1. The golf ball usually has a diameter of approximately 42.67 mm to 43.00 mm. The golf ball has 408 dimples on a surface thereof. The planar shape of the dimple is circular.

The dimple of the golf ball has a regular octahedron pattern. More specifically, a regular octahedron inscribed on a spherical surface is supposed, and the spherical surface is comparted into eight spherical regular triangles through twelve comparting lines obtained by projecting twelve sides of the regular octahedron. FIG. 1 shows four spherical regular triangles T1 to T4. FIG. 2 shows four spherical regular triangles T5 to T8. The dimple is arranged on the inside of each of the spherical regular triangles (T1 to T8). The dimple and the comparting line do not intersect each other. Four comparting lines are continuous so that a great circle path (L1 to L3) is formed. The great circle path L3 is coincident with the contour of the golf ball in FIGS. 1 and 2. The respective comparting lines (L1 to L3) are orthogonal to other comparting lines at apexes (P1 to P6) of the spherical regular triangles. The apexes (P1 to P6) correspond to apexes of the supposed regular octahedron. In an actual golf ball, the great circle paths (L1 to L3) are not recognized as edges but are shown in a solid line of FIGS. 1 and 2 for convenience of description.

Figure 3:
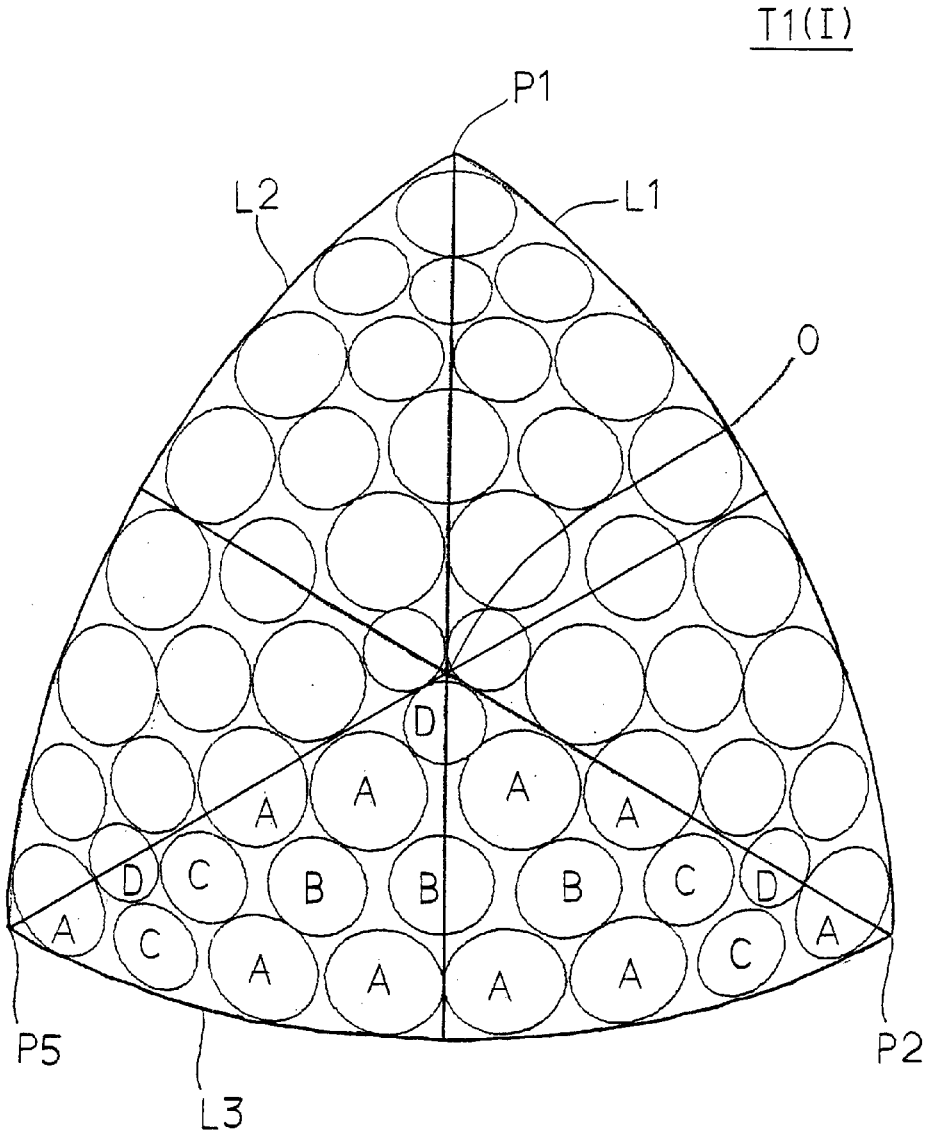
FIG. 3 is an enlarged view showing a spherical regular triangle T1 of the golf ball illustrated in FIG. 1.

FIG. 3 is an enlarged view showing the spherical regular triangle T1. The spherical regular triangle T1 has twenty-four A dimples having a diameter of 4.1 mm, nine B dimples having a diameter of 3.6 mm, twelve C dimples having a diameter of 3.3 mm and six D dimples having a diameter of 2.8 mm. The total number of dimples is 51. In FIG. 3, the type (A to D) of a part of the dimples is illustrated.

The spherical regular triangle T1 has a rotational symmetrical dimple pattern. The rotational symmetrical pattern implies such a state that all the dimples included in the spherical regular triangle rotated by setting a center of gravity as a center of the rotation overlap dimples included in the spherical regular triangle which has not been rotated at least once with a rotating angle of 0 degree to 360 degrees. When the spherical regular triangle T1 is rotated by 120 degrees and 240 degrees by setting a center of gravity O as a center of the rotation, all the dimples overlap the dimples in the spherical regular triangle T1 which has not been rotated.

The dimple pattern of the spherical regular triangle T1 is a line symmetrical pattern. The line symmetrical pattern implies such a state that left and right dimples are line symmetrical with respect to all the three straight lines passing through each apex of the spherical regular triangle and a center of gravity. The dimple pattern of the spherical regular triangle T1 is line symmetrical with respect to a straight line connecting the apex P1 and the center of gravity O, is line symmetrical with respect to a straight line connecting the apex P5 and the center of gravity O, and is line symmetrical with respect to a straight line connecting the apex P2 and the center of gravity O.

Thus, the dimple pattern of the spherical regular triangle T1 is a rotational symmetrical/line symmetrical pattern. The dimple pattern of the spherical regular triangle T7 is also equivalent to that of the spherical regular triangle T1 shown in FIG. 3. The dimple pattern will be hereinafter indicated as (I).

Figure 4:
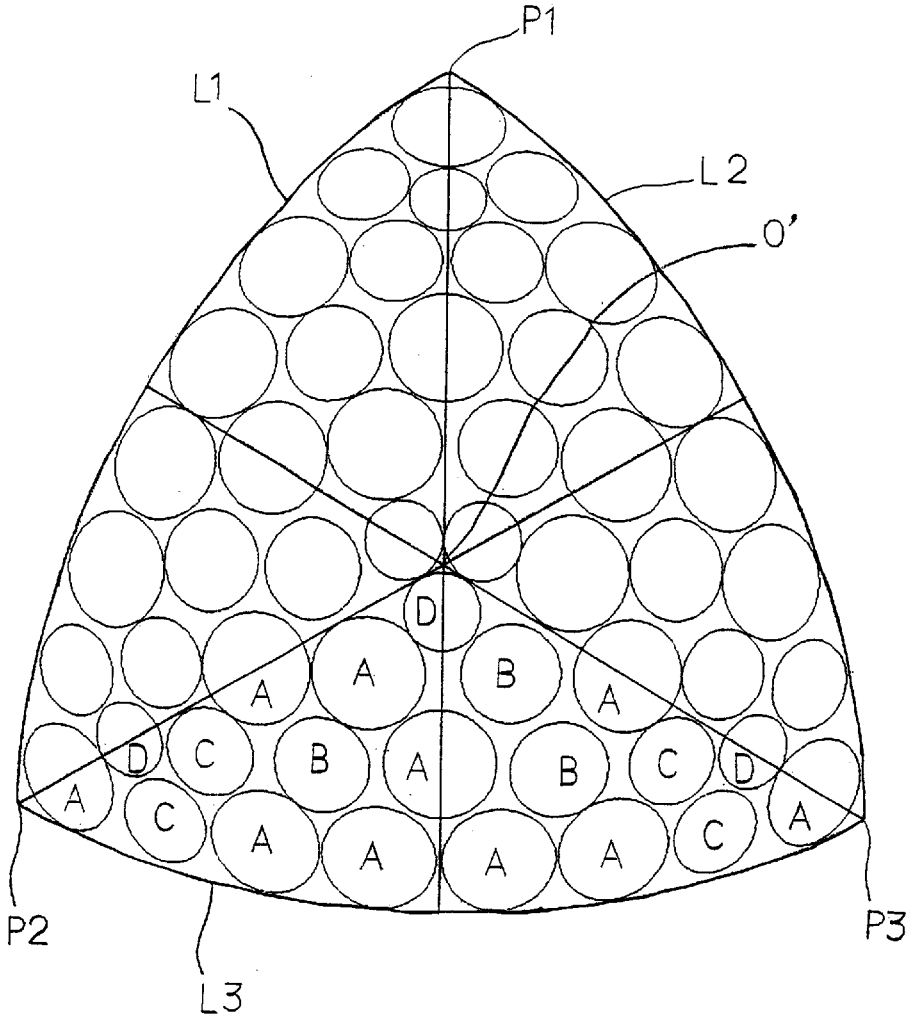
FIG. 4 is an enlarged view showing a spherical regular triangle T2 of the golf ball illustrated in FIG. 1.

FIG. 4 is an enlarged view showing the spherical regular triangle T2. The spherical regular triangle T2 has twenty-four A dimples having a diameter of 4.1 mm, nine B dimples having a diameter of 3.6 mm, twelve C dimples having a diameter of 3.3 mm and six D dimples having a diameter of 2.8 mm. The total number of dimples is 51. In FIG. 4, the type (A to D) of a part of the dimples is illustrated.

The spherical regular triangle T2 has a rotational symmetrical dimple pattern. Accordingly, when the spherical regular triangle T2 is rotated by 120 degrees and 240 degrees by setting a center of gravity O' as a center of the rotation, all the dimples overlap the dimples in the spherical regular triangle T2 which has not been rotated.

The dimple pattern of the spherical regular triangle T2 is not line symmetrical with respect to a straight line connecting the apex P1 and the center of gravity O', is not line symmetrical with respect to a straight line connecting the apex P2 and the center of gravity O', and is not line symmetrical with respect to a straight line connecting the apex P3 and the center of gravity O'. The dimple pattern of the spherical regular triangle T2 is not a line symmetrical pattern (a non-line symmetrical pattern).

Thus, the dimple pattern of the spherical regular triangle T2 is a rotational symmetrical/non-line symmetrical pattern. The dimple pattern of the spherical regular triangle T8 is also equivalent to that of the spherical regular triangle T2 shown in FIG. 4. The dimple pattern will be hereinafter indicated as (II).

Figure 5:
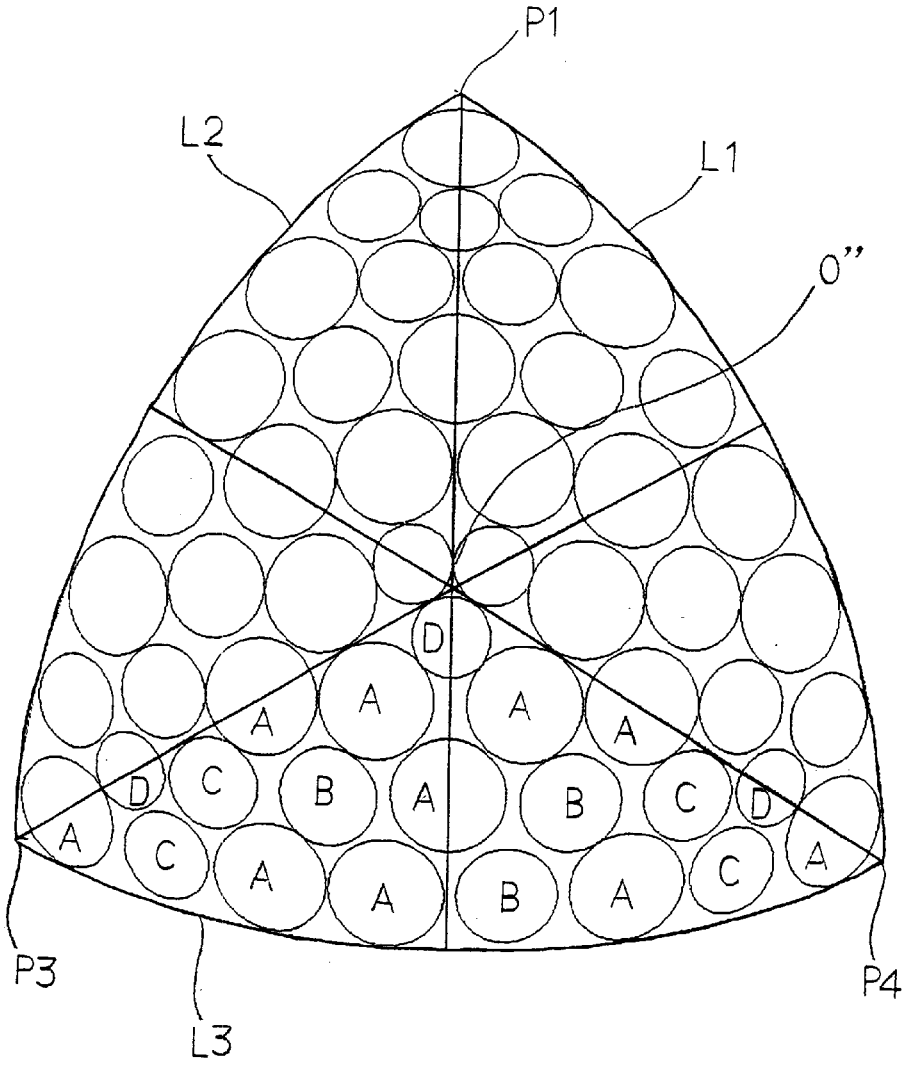
FIG. 5 is an enlarged view showing a spherical regular triangle T3 of the golf ball illustrated in FIG. 1.

FIG. 5 is an enlarged view showing the spherical regular triangle T3. The spherical regular triangle T3 has twenty-four A dimples having a diameter of 4.1 mm, nine B dimples having a diameter of 3.6 mm, twelve C dimples having a diameter of 3.3 mm and six D dimples having a diameter of 2.8 mm. The total number of dimples is 51. In FIG. 5, the type (A to D) of a part of the dimples is illustrated.

The spherical regular triangle T3 has a rotational symmetrical dimple pattern. Accordingly, when the spherical regular triangle T3 is rotated by 120 degrees and 240 degrees by setting a center of gravity O" as a center of the rotation, all the dimples overlap the dimples in the spherical regular triangle T3 which has not been rotated.

The dimple pattern of the spherical regular triangle T3 is not line symmetrical with respect to a straight line connecting the apex P1 and the center of gravity O", is not line symmetrical with respect to a straight line connecting the apex P3 and the center of gravity O", and is not line symmetrical with respect to a straight line connecting the apex P4 and the center of gravity O". The dimple pattern of the spherical regular triangle T3 is not a line symmetrical pattern (a non-line symmetrical pattern).

Thus, the dimple pattern of the spherical regular triangle T3 is a rotational symmetrical/non-line symmetrical pattern. The dimple pattern of the spherical regular triangle T5 is also equivalent to that of the spherical regular triangle T3 shown in FIG. 5. The dimple pattern will be hereinafter indicated as (III).

Figure 6:
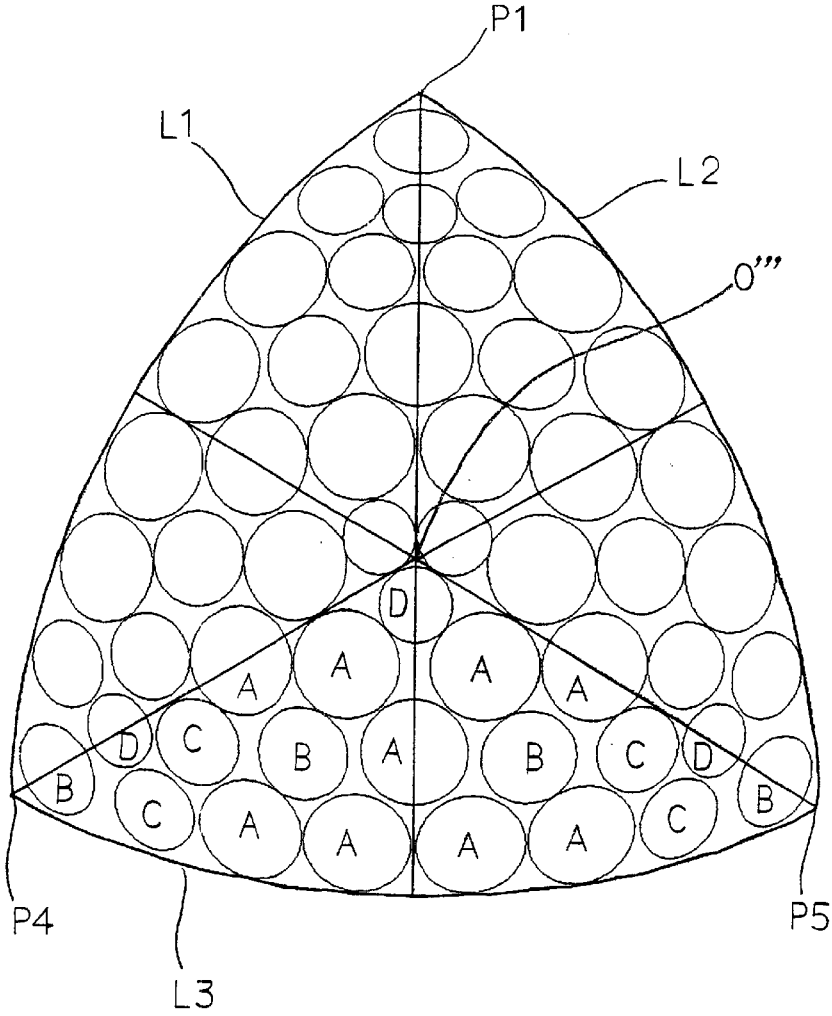
FIG. 6 is an enlarged view showing a spherical regular triangle T4 of the golf ball illustrated in FIG. 1.

FIG. 6 is an enlarged view showing the spherical regular triangle T4. The spherical regular triangle T4 has twenty-four A dimples having a diameter of 4.1 mm, nine B dimples having a diameter of 3.6 mm, twelve C dimples having a diameter of 3.3 mm and six D dimples having a diameter of 2.8 mm. The total number of dimples is 51. In FIG. 6, the type (A to D) of a part of the dimples is illustrated.

The spherical regular triangle T4 has a rotational symmetrical dimple pattern. Accordingly, when the spherical regular triangle T4 is rotated by 120 degrees and 240 degrees by setting a center of gravity O'" as a center of the rotation, all the dimples overlap the dimples in the spherical regular triangle T4 which has not been rotated.

The dimple pattern of the spherical regular triangle T4 is line symmetrical with respect to a straight line connecting the apex P1 and the center of gravity O'", is line symmetrical with respect to a straight line connecting the apex P4 and the center of gravity O'", and is line symmetrical with respect to a straight line connecting the apex P5 and the center of gravity O'". The dimple pattern of the spherical regular triangle T4 is a line symmetrical pattern.

Thus, the dimple pattern of the spherical regular triangle T4 is a rotational symmetrical/line symmetrical pattern. The dimple pattern of the spherical regular triangle T6 is also equivalent to that of the spherical regular triangle T4 shown in FIG. 6. The dimple pattern will be hereinafter indicated as (IV).

In the golf ball, the four spherical regular triangles T1, T2, T3 and T4 sharing the apex P1 have respectively the dimple patterns (I), (II), (III) and (IV) which are different from each other. In the golf ball, the four spherical regular triangles T1, T5, T6 and T2 sharing the apex P2 have respectively the dimple patterns (I), (III), (IV) and (II) which are different from each other. In the golf ball, the four spherical regular triangles T2, T6, T7 and T3 sharing the apex P3 have respectively the dimple patterns (II), (IV), (I) and (III) which are different from each other. In the golf ball, the four spherical regular triangles T4, T3, T7 and T8 sharing the apex P4 have respectively the dimple patterns (IV), (III), (I) and (II) which are different from each other. In the golf ball, the four spherical regular triangles T1, T4, T8 and T5 sharing the apex P5 have respectively the dimple patterns (I), (IV), (II) and (III) which are different from each other. In the golf ball, the four spherical regular triangles T5, T8, T7 and T6 sharing the apex P6 have respectively the dimple patterns (III), (II), (I) and (IV) which are different from each other.

When the golf ball flies such that the great circle path L1 is coincident with the highest speed portion, the four spherical regular triangles T1, T5, T8 and T4 repetitively appear on one of the sides of the great circle path L1 with rotation. More specifically, the dimple patterns (I), (III), (II) and (IV) appear. These four dimple patterns are different from each other. Moreover, the four spherical regular triangles T2, T6, T7 and T3 repetitively appear on the other side of the great circle path L1 with the rotation. More specifically, the dimple patterns (II), (IV), (I) and (III) appear. These four dimple patterns are different from each other. Thus, all the dimple patterns appearing on both sides of the great circle path L1 have (I) to (IV) mixed therein. In other words, the dimple patterns appearing on both sides of the great circle path L1 are not monotonous.

When the golf ball flies such that the great circle path L2 is coincident with the highest speed portion, the four spherical regular triangles T1, T5, T6 and T2 repetitively appear on one of the sides of the great circle path L2 with the rotation. More specifically, the dimple patterns (I), (III), (IV) and (II) appear. These four dimple patterns are different from each other. Moreover, the four spherical regular triangles T4, T8, T7 and T3 repetitively appear on the other side of the great circle path L2 with the rotation. More specifically, the dimple patterns (IV), (II), (I) and (III) appear. These four dimple patterns are different from each other. Thus, all the dimple patterns appearing on both sides of the great circle path L2 have (I) to (IV) mixed therein. In other words, the dimple patterns appearing on both sides of the great circle path L2 are not monotonous.

When the golf ball flies such that the large circle path L3 is coincident with the highest speed portion, the four spherical regular triangles T1, T2, T3 and T4 repetitively appear on one of the sides of the great circle path L3 with the rotation. More specifically, the dimple patterns (I), (II), (III) and (IV) appear. These four dimple patterns are different from each other. Moreover, the four spherical regular triangles T5, T6, T7 and T8 repetitively appear on the other side of the great circle path L3 with the rotation. More specifically, the dimple patterns (III), (IV), (I) and (II) appear. These four dimple patterns are different from each other. Thus, all the dimple patterns appearing on both sides of the great circle path L3 have (I) to (IV) mixed therein. In other words, the dimple patterns appearing on both sides of the great circle path L3 are not monotonous.

In the golf ball, even if any of the great circle paths L1, L2 and L3 is coincident with the highest speed portion, the dimple patterns appearing on both sides of the great circle paths L1, L2 and L3 are not monotonous, resulting in an enhancement in the dimple effect. Accordingly, it is possible to complement a reduction in the dimple effect caused by non-existence of the dimples on the great circle paths L1, L2 and L3. Moreover, even if the seam (any of the great circle paths L1, L2 and L3) is coincident with the highest speed portion, it is possible to complement a reduction in the dimple effect caused by the deformation of the dimples around the seam through spew grinding. In the golf ball, consequently, it is possible to prevent a difference in flight performance from being made between the case in which the highest speed portion is coincident with the great circle paths L1, L2 and L3 and the case in which the highest speed portion is not coincident with the great circle paths L1, L2 and L3.

The spherical regular triangle T1 has a dimple pattern which is rotational symmetrical. Therefore, even if any of the great circle paths L1, L2 and L3 is coincident with the highest speed portion, the degree of contribution of the spherical regular triangle T1 to the dimple effect of the whole golf ball is equivalent to that obtained when any of other great circle paths is coincident with the highest speed portion. Other spherical regular triangles (T2 to T8) also have dimple patterns which are rotational symmetrical. Therefore, even if any of the great circle paths L1, L2 and L3 is coincident with the highest speed portion, the degree of contribution of each spherical regular triangle to the dimple effect of the whole golf ball is equivalent to that obtained when any of the other great circle paths is coincident with the highest speed portion.

In the golf ball, in the case in which any of the great circle paths L1, L2 and L3 is coincident with the highest speed portion, two rotational symmetrical/line symmetrical dimple patterns (that is, the dimple patterns (I) and (IV)) and two rotational symmetrical/non-line symmetrical dimple patterns (that is, the dimple patterns (II) and (III)) appear on the left and right. Thus, the dimple pattern shaving different symmetric properties are mixed. Consequently, the dimple effect can be enhanced still more. The ratio of both patterns may be 1:3 or 3:1, preferably, 2:2 as in the present embodiment.

While each of the spherical regular triangles (T1 to T8) of the golf ball has 51 dimples arranged therein, the number of the dimples to be arranged can be changed properly. It is preferable that the number of the dimples should be 40 to 55. In some cases in which the number of the dimples is less than 40, portions (land portions) other than the dimples are increased over the surface of the golf ball so that the dimple effects are reduced, resulting in poor flight performance of the golf ball. To the contrary, in some cases in which the number of the dimples is more than 55, the sizes of the individual dimples are decreased so that the dimple effects are reduced, resulting in poor flight performance of the golf ball.

The spherical regular triangles (T1 to T8) may have different numbers of dimples arranged therein each other. In respect of the maintenance of aerodynamic symmetry, a difference between the number of dimples in the spherical regular triangle having the greatest number of dimples arranged therein and the number of dimples in the spherical regular triangle having the smallest number of dimples arranged therein is preferably four or less, more preferably three or less, most preferably two or less, and ideally zero. Moreover, it is preferable that the number of dimples for each dimple type should be unified between the spherical regular triangles (T1 to T8) if possible.

EXAMPLES

An ionomer resin composition was subjected to injection molding to form a cover around a core made of solid rubber. Thus, a golf ball according to the example which has a regular octahedron dimple pattern shown in FIGS. 1 to 6 was obtained. A parting line of a mold during the injection molding was caused to be coincident with a great circle path L1. The golf ball had a diameter of 42.70 mm±0.03 mm and a compression of 90±2. Moreover, the sum of dimple volumes (a volume between a plane including a dimple edge and a dimple surface) was approximately 320 $mm^3$.

Comparative Example 1

Figure 7:
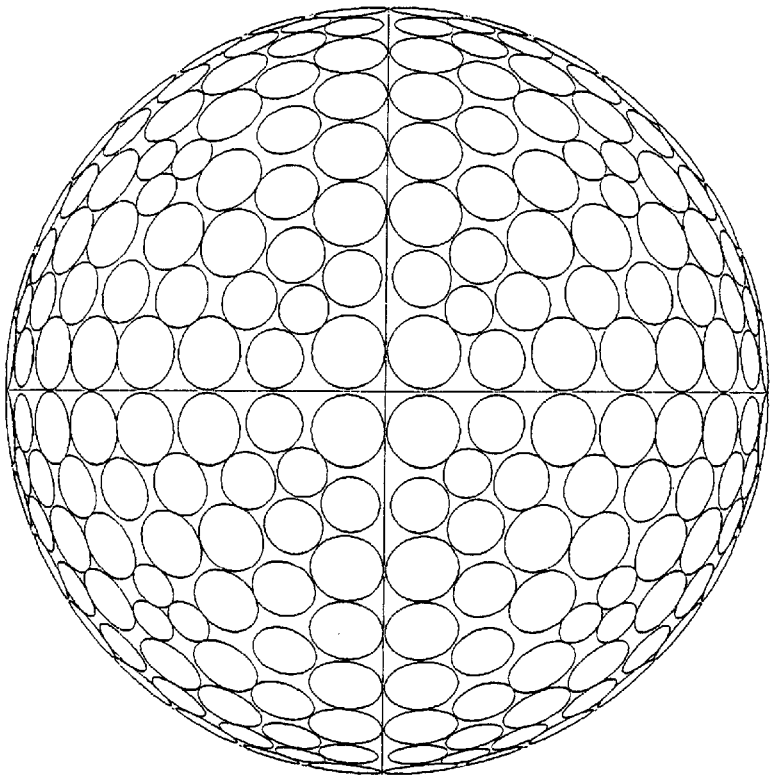
FIG. 7 is a front view showing a golf ball according to a comparative example.

The same golf ball as that in the example was fabricated for a comparative example except that it has a regular octahedron pattern and all dimple patterns of eight spherical regular triangles shown in FIG. 3 (rotational symmetrical/line symmetrical dimple patterns) are employed. FIG. 7 is a front view showing the golf ball according to the comparative example. A rear view showing the golf ball is also identical to FIG. 7.

Symmetry Test 120 golf balls according to the example and 120 golf balls according to the comparative example were prepared. On the other hand, a driver (W1) having a metal head was attached to a swing robot manufactured by True Temper Co. and the conditions of a machine were adjusted to set a head speed of approximately 49 m/s, a launch angle of approximately 11 degrees and a backspin rotating speed of approximately 3000 rpm. Then, each golf ball was hit to measure a carry (a distance from a shooting point to a falling point). Setting is carried out in the following six ways: 1) the great circle path L1 is coincident with the highest speed portion, 2) the great circle path L2 is coincident with the highest speed portion, 3) the great circle path L3 is coincident with the highest speed portion, 4) a great circle passing through the apex P1 and the center of gravity O is coincident with the highest speed portion, 5) a great circle passing through the apex PS and the center of gravity O is coincident with the highest speed portion, and 6) a great circle passing through the apex P2 and the center of gravity O is coincident with the highest speed portion. 20 golf balls were hit for each setting. A mean value in the results of measurement is shown in the following Table 1. An almost head wind blew at a mean speed of approximately 1 m/s during the test.

TABLE 1

Result of Symmetry Test

| Great circle coincident with highest speed portion | Example | Carry (m) Comparative Example |
|---|---|---|
| Great circle path L1 (seam) | 228. 2 | 226. 0 |
| Great circle path L2 | 228. 6 | 226. 4 |
| Great circle path L3 | 228. 4 | 226. 6 |
| Great circle passing through apex P1 and center of gravity 0 | 228. 5 | 227. 3 |
| Great circle passing through apex P5 and center of gravity 0 | 228. 9 | 227. 2 |
| Great circle passing through apex P2 and center of gravity 0 | 228. 8 | 227. 1 |
| Mean | 228. 6 | 226. 8 |

In the Table 1, the golf ball according to the example has a smaller difference in a carry based on a variation in the hitting than the golf ball according to the comparative example. The mean carry of the golf ball according to the example is greater than that of the golf ball according to the comparative example. From the results of evaluation, the advantages of the present invention have been apparent.

The above description is only illustrative and can be variously changed without departing from the scope of the present invention.

What is claimed is:

1. A golf ball in which a surface thereof is comparted into eight spherical regular triangles through twelve comparting lines formed by projecting, onto the surface, twelve sides of a regular octahedron inscribed on the surface and dimples are arranged in the spherical regular triangles so as not to intersect any of the comparting lines, resulting in formation of three great circle paths, wherein each of four spherical regular triangles sharing each of six apexes of the regular octahedron positioned on the surface has different dimple pattern from those of three other spherical regular triangles, respectively.

2. The golf ball according to claim 1, wherein all the eight spherical regular triangles have dimple patterns which are rotational symmetrical.

3. The golf ball according to claim 2, wherein one to three of four spherical regular triangles sharing each of the six apexes of the regular octahedron have dimple patterns which are rotational symmetrical and line symmetrical and the other spherical regular triangles have dimple patterns which are rotational symmetrical and are not line symmetrical.

4. The golf ball according to claim 3, wherein two of the four spherical regular triangles sharing each of the six apexes of the regular octahedron have dimple patterns which are rotational symmetrical and line symmetrical and two other spherical regular triangles have dimple patterns which are rotational symmetrical and are not line symmetrical.

5. The golf ball according to claim 1, wherein each of the eight spherical regular triangles has 40 to 55 dimples arranged therein.

6. The golf ball according to claim 1, wherein a difference between the number of dimples in the spherical regular triangle having the greatest number of dimples arranged therein and the number of dimples in the spherical regular triangle having the smallest number of dimples arranged therein is four or less.

7. The golf ball according to claim 1, wherein one of the three great circle paths is coincident with a seam to be a portion corresponding to a parting line of a pair of golf ball molds having semispherical cavities.

* * * * *